US012637842B2

(12) United States Patent
Callaway et al.

(10) Patent No.: US 12,637,842 B2
(45) Date of Patent: May 26, 2026

(54) MODIFYING A ROTATIONAL POSITION OF A BOOM OF A MACHINE

(71) Applicant: Caterpillar Inc., Peoria, IL (US)

(72) Inventors: Joshua D. Callaway, Cary, NC (US); Justin P. Pahl, Holly Springs, NC (US)

(73) Assignee: Caterpillar Inc., Peoria, IL (US)

( * ) Notice: Subject to any disclaimer, the term of this patent is extended or adjusted under 35 U.S.C. 154(b) by 288 days.

(21) Appl. No.: 17/747,083

(22) Filed: May 18, 2022

(65) Prior Publication Data

US 2023/0374758 A1 Nov. 23, 2023

(51) Int. Cl.
*E02F 9/26* (2006.01)
*E02F 3/38* (2006.01)
*E02F 9/22* (2006.01)

(52) U.S. Cl.
CPC ..... *E02F 9/265* (2013.01); *E02F 3/384* (2013.01); *E02F 9/2203* (2013.01)

(58) Field of Classification Search
CPC ..... E02F 9/265; E02F 3/384; E02F 9/2203; E02F 3/439
See application file for complete search history.

(56) References Cited

U.S. PATENT DOCUMENTS 5,088,020 A * 2/1992 Nishida ..... E02F 9/2033 701/50
5,446,980 A * 9/1995 Rocke ..... E02F 3/439 701/50
5,704,429 A 1/1998 Lee et al.
5,748,097 A * 5/1998 Collins ..... E02F 3/437 340/685
8,776,512 B2 7/2014 Lastre et al.
9,739,372 B2 * 8/2017 Neumann ..... F16H 61/20
10,508,415 B2 12/2019 Kim
2004/0010359 A1 * 1/2004 Koch ..... E02F 9/265 701/50
2004/0045289 A1 * 3/2004 Ikeda ..... E02F 9/2214 60/469

(Continued)

FOREIGN PATENT DOCUMENTS

EP 1650358 A2 4/2006
JP S59102022 A 6/1984

(Continued)

OTHER PUBLICATIONS

Extended European Search Report for European patent appln. no. 23170222.6, mailed Oct. 11, 2023 (8 pgs).

*Primary Examiner* — Faris S Almatrahi
*Assistant Examiner* — Dana F Artimez

(57) ABSTRACT

A method may include receiving, from a position sensor associated with a machine, data indicative of a horizontal rotation angle of a boom of the machine. The position sensor may be fixedly mounted to a boom link of the machine and may be fixedly connected through one or more links to the boom. The method may further include sending, to a boom actuator, one or more commands to modify a horizontal position of the boom to a target horizontal position or to a default horizontal position. The target horizontal position may include a position of the boom prior to drift in the horizontal position during operation of linkage elements of the machine and the default horizontal position may include a position of the boom to which the boom is to return after use.

20 Claims, 4 Drawing Sheets

(56) References Cited

U.S. PATENT DOCUMENTS

| | | | | |
|---|---|---|---|---|
| 2014/0172246 | A1* | 6/2014 | Farmer | E21B 7/025 701/50 |
| 2020/0024829 | A1* | 1/2020 | Fiser | E02F 3/964 |
| 2020/0354920 | A1* | 11/2020 | Horii | E02F 3/435 |
| 2021/0009215 | A1 | 1/2021 | Jagtap et al. | |
| 2021/0087777 | A1* | 3/2021 | Kenkel | E02F 9/2041 |
| 2021/0285183 | A1* | 9/2021 | Horii | E02F 3/435 |
| 2021/0332555 | A1 | 10/2021 | Metzger et al. | |
| 2023/0018606 | A1* | 1/2023 | Kalantar | G01B 21/22 |

FOREIGN PATENT DOCUMENTS

| | | | |
|---|---|---|---|
| JP | 2020169515 | A | 10/2020 |
| KR | 100212648 | B1 | 8/1999 |
| KR | 102109155 | B1 | 5/2020 |

* cited by examiner

MODIFYING A ROTATIONAL POSITION OF A BOOM OF A MACHINE

TECHNICAL FIELD

The present disclosure relates generally to a machine with a boom, and more particularly, to modifying a rotational position of the boom.

BACKGROUND

Digging machines, e.g., hydraulic excavators, may be used in a wide variety of construction, mining, paving, etc. sites to perform common operations such as excavation, trenching, and many other types of earth moving operations. Excavators may include a hydraulically or pneumatically or electrically controlled excavating implement that may be manipulated by controlling the swing and curl functions of an excavating linkage assembly, e.g., a boom, a stick, etc. Precise position control of the linkage assembly may be needed to prevent the working mechanism from hitting surrounding structures as it is turned into different directions during a ground working operation, to prevent work on restricted areas, and/or the like, especially in a limited space. Furthermore, loads on an implement attached to the boom or rotation about an axis may cause position inaccuracies with respect to the boom. Thus, precise position control of boom rotation may have to include holding the boom to a specific position, and there may be numerous challenges to doing this due to engine vibrations, mechanical errors, gravitational forces, and/or unpredictable disturbances.

Japanese Publication No. 2020169515 A, published on Oct. 15, 2020 ("the '515 publication"), describes a hydraulic shovel that includes a turning body and a turning angle sensor that detects the turning angle of the turning body. A turning restriction area consisting of a turning stop area and a turning deceleration area is set, and when the position of the bucket is in the turning deceleration area, the turning of the turning body is decelerated and when the position is in the turning stop region, the turning of the turning body is stopped. However, the '515 publication does not disclose modifying a rotational position of a boom of a machine.

The system of the present disclosure may solve one or more of the problems set forth above and/or other problems in the art. The scope of the current disclosure, however, is defined by the attached claims, and not by the ability to solve any specific problem.

SUMMARY

In one aspect, a system associated with a machine may include a boom actuator, a position sensor, and a rotational position system. The rotational position system may be configured to receive, from the position sensor, data indicative of a horizontal rotation angle of a boom of the machine and send, to the boom actuator, one or more commands to modify a horizontal position of the boom to a target horizontal position or to a default horizontal position.

In another aspect, a method may include receiving, from a position sensor associated with a machine, data indicative of a horizontal rotation angle of a boom of the machine. The position sensor may be fixedly mounted to a boom link of the machine and may be fixedly connected through one or more links to the boom. The method may further include sending, to a boom actuator, one or more commands to modify a horizontal position of the boom to a target horizontal position or to a default horizontal position. The target horizontal position may include a position of the boom prior to drift in the horizontal position during operation of linkage elements of the machine and the default horizontal position may include a position of the boom to which the boom is to return after use.

In yet another aspect, a rotational position system may be associated with a machine. The rotational position system may be configured to receive, from a position sensor associated with the machine, data indicative of a horizontal rotation angle of a boom of the machine. The position sensor may be fixedly mounted to a boom link of the machine and may be fixedly connected through one or more links to the boom. The rotational position system may be further configured to send, to a boom actuator, one or more commands to modify a horizontal position of the boom to a target horizontal position or to a default horizontal position. The target horizontal position may include a position of the boom prior to drift in the horizontal position during use of linkage elements of the machine and the default horizontal position may include a position of the boom to which the boom is to return after use.

Other features and aspects of this disclosure will be apparent from the following description and the accompanying drawings.

BRIEF DESCRIPTION OF THE DRAWINGS

The accompanying drawings, which are incorporated in and constitute a part of this specification, illustrate various exemplary aspects and together with the description, serve to explain the principles of the disclosed aspects.

DETAILED DESCRIPTION

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. In this disclosure, unless stated otherwise, relative terms, such as, for example, "about," "substantially," and "approximately" are used to indicate a possible variation of ±10% in the stated value.

Figure 1:
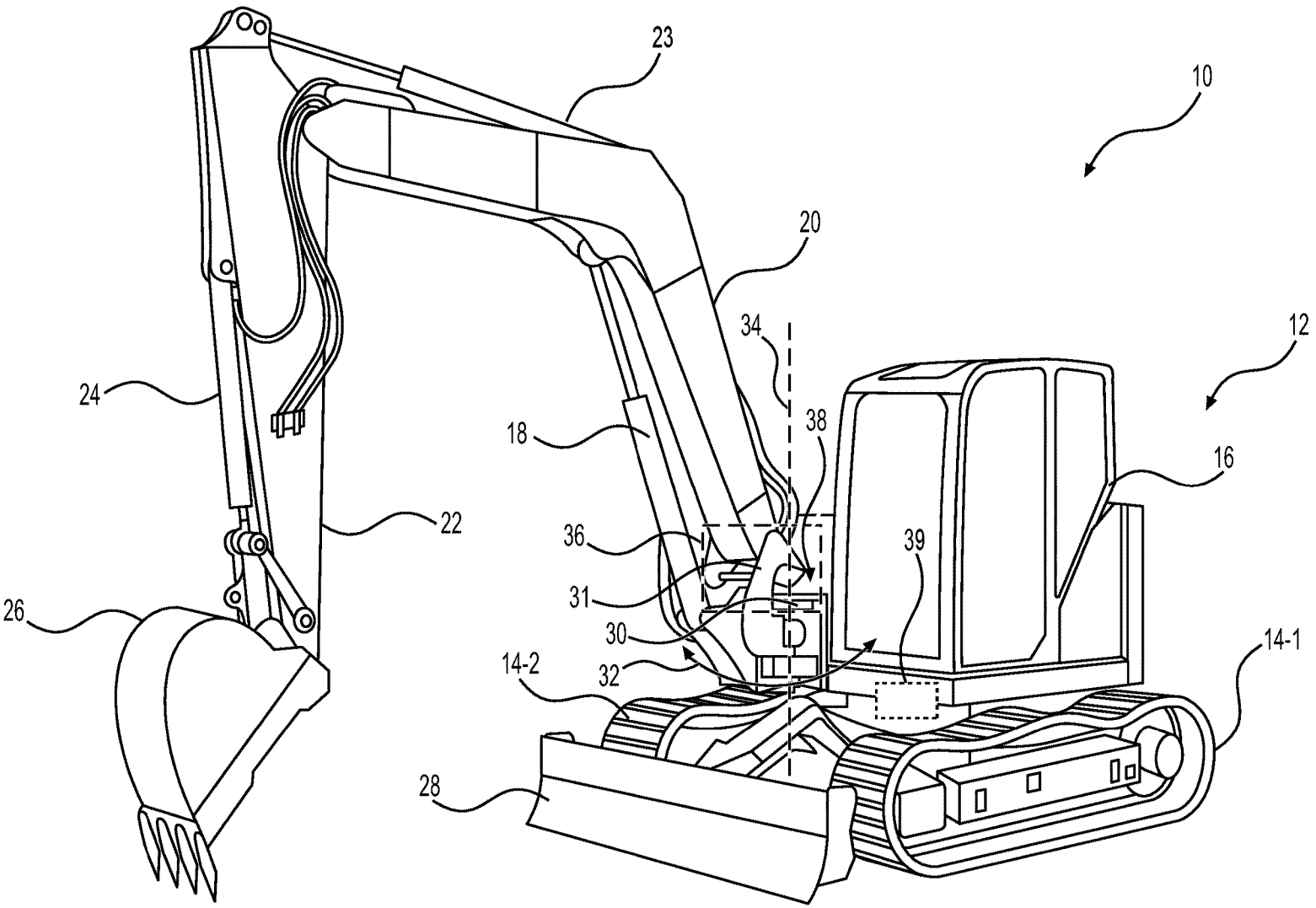
FIG. 1 is a schematic diagram of an exemplary machine, according to aspects of the disclosure.

FIG. 1 is a schematic diagram of an exemplary machine 10, according to aspects of the disclosure. Although FIG. 1 illustrates the machine 10 as being an excavator, the machine 10 may include any type of machine used in mining, construction, paving, logging, etc. with elements that can rotate, such as a tractor, wheel loader, wheel tractor-scraper, skid-steer and compact track loader, track loader, off-highway truck, forest machine, articulated truck, cold planer, dozer, mining excavator, material handler, motor grader, pipeplayer, road reclaimer, telehandler, paver, backhoe loader, etc. The machine 10 can include a body 12, an engine (not illustrated in FIG. 1), a pump (not illustrated in FIG. 1), tracks 14-1 and 14-2, a cabin 16, a first hydraulic actuator 18, a boom 20, a stick 22, a second hydraulic actuator 23, a third hydraulic actuator 24, a first implement 26 (illustrated as a bucket 26, for example), a second implement 28 (illustrated as a blade 28, for example), a boom link 30 fixedly connected to the body 12, a swing casting 31 fixedly connected to an end of the boom 20 and to the boom link 30, a position sensor 38, and a rotational position system 39.

The body 12 of the machine 10 may include a chassis, frame, and exterior panels of the machine 10 and may be configured to support and house various components of the machine 10 such as the engine, the pump, the tracks 14-1 and 14-2, the cabin 16, and the rotational position system 39. The engine may include a combustion, electric, hybrid, or other type of motor configured to produce mechanical energy. The pump may include a hydraulic pump connected to the engine and may be powered thereby. In some examples, the pump may be connected to one or more valves for controlling and distributing hydraulic fluid to various hydraulic actuators of the machine 10, such as the first hydraulic actuator 18, the second hydraulic actuator 23, and the third hydraulic actuator 24. The tracks 14-1 and 14-2 may include a set of movable tracks powered by the engine and connected to the body 12. The tracks 14-1 and 14-2 may be operable by the engine to move the machine 10. In some aspects, the machine 10 may include wheels or other components for moving the machine 10 additionally or alternatively to the tracks 14-1 and 14-2.

The boom 20 may be connected at one end to the body 12 via the swing casting 31 and the boom link 30. For example, the boom 20 may be connected at one end to the swing casting 31, and the swing casting 31 and the boom link 30 may be configured such that when the boom 20 is fixedly connected to the boom link 30 via the swing casting 31, the boom 20 may rotate (via rotation of the swing casting 31) about an axis 34 in a horizontal direction 32 (e.g., horizontally from side-to-side). The machine 10 may be configured with one or more actuators (e.g., hydraulic actuators, electro-mechanical actuators, etc.) to move the boom 20 about the axis 34. The boom 20 may be further fixedly connected at another end to the stick 22, and the stick 22 may be fixedly connected at another end to the bucket 26. Each of the first hydraulic actuator 18, the second hydraulic actuator 23, and the third hydraulic actuator 24 may be connected to and powered by the pump and the rotational position system 39, as noted above. The first hydraulic actuator 18 may be connected to the body 12 and the boom 20 to actuate the boom 20; the second hydraulic actuator 23 may be connected to the boom 20 and the stick 22 to actuate the stick 22; and, the third hydraulic actuator 24 may be connected to the stick 22 and the bucket 26 to actuate the bucket 26. In addition, the machine 10 may be configured with one or more actuators to move the blade 28 (e.g., to change a vertical position of the blade 28, to angle the blade 28 toward a left or right side of the machine 10, etc.).

The cabin 16 may be connected to the body 12 and configured to enclose an operator therein. The cabin 16 may include various controls mounted therein for controlling the operation of, for example, the engine, the pump, the tracks 14-1 or 14-2, the boom 20, the stick 22, the bucket 26, and the blade 28. In some examples, an operator may use the controls within the cabin 16 to move the machine 10 using the tracks 14-1 and 14-2. The operator may further articulate the boom 20 and stick 22 to position the bucket 26 or the blade 28 relative to the body 12. The operator may use various controls to tilt, rotate, and scoop or curl the bucket 26 to perform various tasks, such as moving dirt and other materials during an excavating process. Similarly, the operator may use various controls to adjust a height, rotation, angle, etc. of the blade 28. Although FIG. 1 illustrates a bucket 26 and a blade 28 as example implements, other implements may be used, such as a drill, cutters, a breaker, a scraper, etc.

As further illustrated in FIG. 1, the machine 10 may further include a position sensor 38, which may be attached to the boom link 30, in some examples. The mechanical junction of the swing casting 31 to the boom link 30 is illustrated by the dashed rectangle 36. The position sensor 38 may be fixedly connected to the boom 20 and/or the swing casting 31 via one or more mechanical links. For example, the mechanical links may include a 2-bar linkage, a 4-bar linkage, etc.

The position sensor 38 may include, e.g., a rotary potentiometer or hall effect sensor. In some aspects of the disclosure, the position sensor 38 may operate according to controller area network (CAN) standards or may include an analog sensor. The position sensor may be communicatively connected to the rotational position system 39. The rotational position system 39 may have hardware and/or software-based components for monitoring, controlling, and communicating with the machine 10 (or components thereof, such as the tracks 14-1 and 14-2, the boom 20, the stick 22, the hydraulic actuators 18, 23, or 24, the bucket 26, and/or the position sensor 38). In some aspects, the rotational position system 39 may receive data from the position sensor 38.

The rotational position system 39 may include one or more server devices, processors, and/or memory located on-board the machine 10 or located remote from the machine 10. In this way, certain aspects of the disclosure may process data remote from the position sensor 38 and/or the machine 10. In the illustrated example, the memory of the rotational position system 39 may store software-based components to perform various processes and techniques described herein, including the methods illustrated in FIG. 3 and/or FIG. 4.

A processor may include a central processing unit (CPU), a graphics processing unit (GPU), a microprocessor, a digital signal processor and/or other processing units or components. Additionally, or alternatively, the functionality described herein can be performed, at least in part, by one or more hardware logic components. For example, and without limitation, illustrative types of hardware logic components that may be used include field-programmable gate arrays (FPGAs), application-specific integrated circuits (ASICs), application-specific standard products (ASSPs), system-on-a-chip systems (SOCs), complex programmable logic devices (CPLDs), etc. Additionally, the processor may possess its own local memory, which also may store program modules, program data, and/or one or more operating systems. The processor may include one or more cores.

Memory may be a non-transitory computer-readable medium that may include volatile and/or nonvolatile memory, removable and/or non-removable media implemented in any method or technology for storage of information, such as computer-readable instructions, data structures, program modules, or other data. Such memory includes, but is not limited to, random access memory (RAM), read-only memory (ROM), electrically erasable programmable read-only memory (EEPROM), flash memory or other memory technology, compact disc read-only memory (CD-ROM), digital versatile discs (DVD) or other optical storage, magnetic cassettes, magnetic tape, magnetic disk storage or other magnetic storage devices, redundant array of independent disks (RAID) storage systems, or any other medium which can be used to store the desired information and which can be accessed by a computing device (e.g., a user device, a server device, etc.). The memory may be implemented as computer-readable storage media (CRSM), which may be any available physical media accessible by the processor to execute instructions stored on the memory. The memory may have an operating system (OS) and/or a variety of suitable applications stored thereon. The OS, when executed by the processor, may enable management of hardware and/or software resources of the rotational position system 39.

Figure 2:
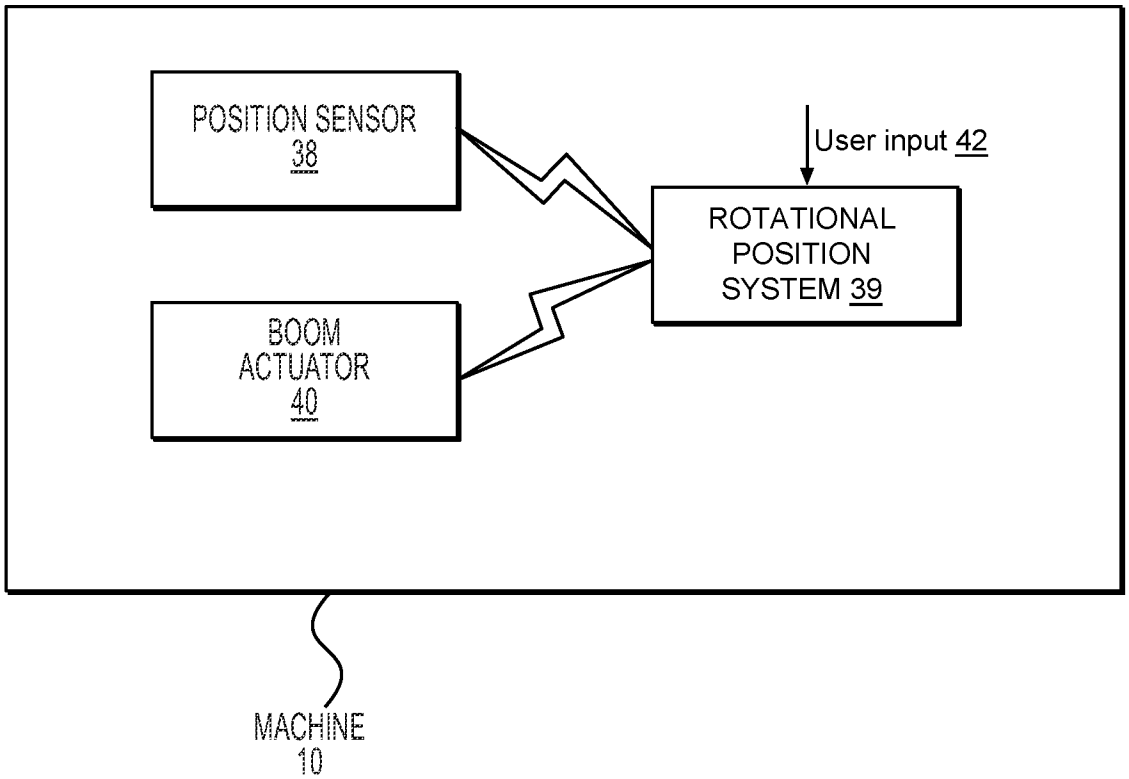
FIG. 2 is a schematic diagram of a system of the machine of FIG. 1, according to aspects of the disclosure.

FIG. 2 is a schematic diagram of a system of the machine 10 of FIG. 1, according to aspects of the disclosure. For example, the system may monitor and/or modify the rotational position of the boom 20. As illustrated, the system may include the position sensor 38, the rotational position system 39, and a boom actuator 40. The boom actuator 40 may include one or more mechanical, hydraulic, or electric components configured to cause the boom 20 to rotate in a horizontal plane about the axis 34. As further illustrated in FIG. 2, the position sensor 38 and the boom actuator 40 may be communicatively coupled to the rotational position system 39. For example, the position sensor 38 and the boom actuator 40 may be connected to the rotational position system 39 via one or more wired and/or wireless communication channels. As described elsewhere herein, the position sensor 38 may provide data to the rotational position system 39 related to a rotational position of the boom 20 and/or boom casting 31 and the rotational position system 39 may provide one or more control signals to the boom actuator 40 to modify the rotational position of the boom 20 and/or the boom casting 31. As further illustrated, the rotational position system 39 may receive user input 42, which may be used to set a target horizontal rotation angle, to set a default horizontal rotation angle, to control the boom actuator 40, and/or the like, as described in more detail elsewhere herein.

INDUSTRIAL APPLICABILITY

The aspects of the rotational position system 39 of the present disclosure may be used to determine a horizontal rotation angle (e.g., a position or a horizontal position) of a boom 20 and/or a boom casting 31 and may modify the horizontal rotation angle to a target horizontal rotation angle (e.g., a target horizontal position) or from a current horizontal rotation angle (e.g., a current horizontal position) to a default horizontal rotation angle (e.g., a default horizontal position). Thus, certain aspects described herein may provide various advantages to operation of a machine 10. For example, by modifying the horizontal rotation angle to the target horizontal rotation angle, certain aspects may make real-time (or near real-time) adjustments to the boom 20 and/or swing casting 31 to correct for position drift that may occur, e.g., as a result of weighted loads in the bucket 26 and/or loads bearing on the end of the boom 20. In this way, certain aspects of the disclosure may help to maintain an accurate position of the boom 20 and/or swing casting 31 during operations of the machine 10. This may facilitate accurate digging, drilling, cutting, and/or the like without direct operator control.

Figure 3:
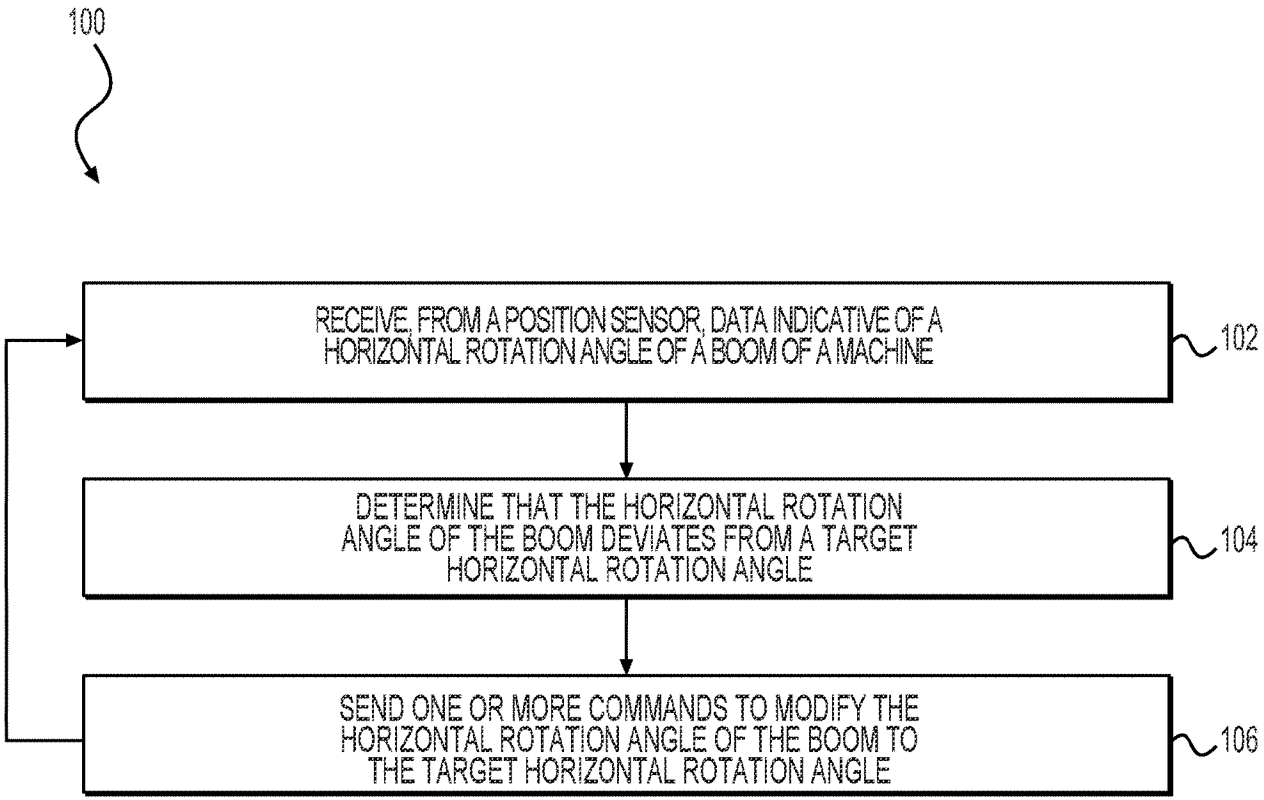
FIG. 3 illustrates a flowchart depicting an exemplary method for modifying a rotational position of a boom to a target position, according to aspects of the disclosure.
Figure 4:
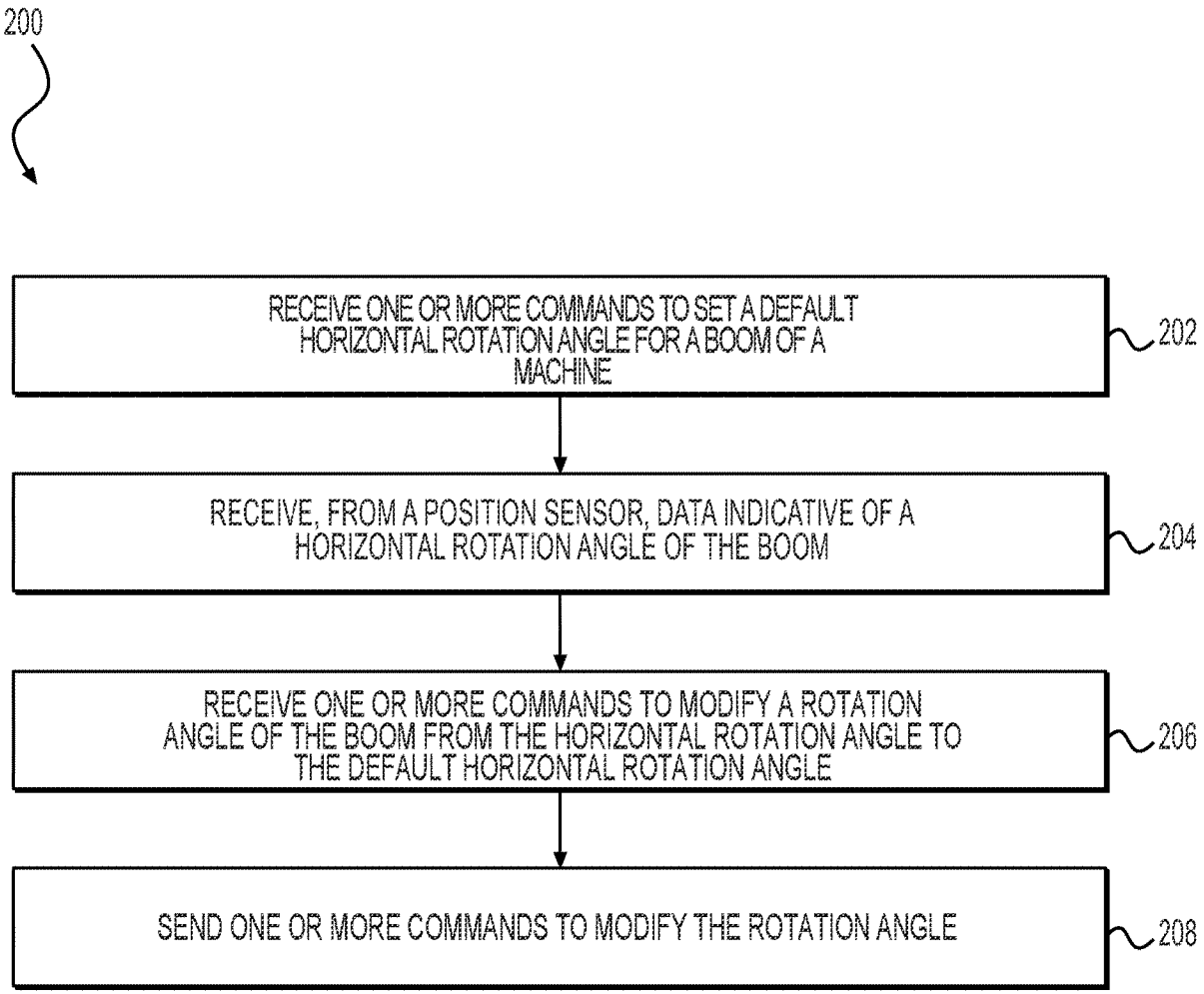
FIG. 4 illustrates a flowchart depicting an exemplary method for modifying a rotational position of a boom to a default position, according to aspects of the disclosure.

FIG. 3 illustrates a flowchart depicting an exemplary method 100 for modifying a rotational position of a boom 20 and/or boom casting 31 of the machine 10 of FIG. 1 to a target rotation position and FIG. 4 illustrates a flowchart depicting an exemplary method 200 for modifying a rotational position of the boom 20 to a default position, according to aspects of the disclosure. The method 100 illustrated in FIG. 3 and the method 200 illustrated in FIG. 4 may be implemented by the rotational position system 39. The steps of the method 100 and/or the method 200 described herein may be embodied as machine readable and executable software instructions, software code, or executable computer programs stored in a memory and executed by a processor of the rotational position system 39. The software instructions may be further embodied in one or more routines, subroutines, or modules and may utilize various auxiliary libraries and input/output functions to communicate with other equipment. The method 100 illustrated in FIG. 3 and/or the method 200 illustrated in FIG. 4 may also be associated with an operator interface (e.g., a human-machine interface, such as a graphical user interface (GUI)) through which an operator of the machine 10 may view data associated with the horizontal rotation of the boom 20 or swing casting 31 and/or may control operations of the machine 10. Therefore, the method 100 may be implemented by the rotational position system 39 to provide for detecting a deviation in the horizontal rotation position and/or modifying the horizontal rotation position to the target horizontal rotation position. For example, the rotational position system 39 may detect deviation of the horizontal rotation position of the boom 20 from the target horizontal rotation position and may perform one or more actions based on the detected deviation. Additionally, or alternatively, the method 200 may be implemented by the rotational position system 39 to provide for modifying a horizontal rotation position of the boom 20 to a default position. For example, the rotational position system 39 may return the boom 20 (and/or swing casting 31) to a straight ahead position after use of the boom 20 for digging, excavating, drilling, etc. The methods 100 and 200 are each described in more detail below.

As noted above, FIG. 3 illustrates a flowchart depicting an exemplary method 100 for modifying a rotational position of a boom 20 to a target position, according to aspects of the disclosure. At step 102, the method 100 may include receiving, from a position sensor 38, data indicative of a horizontal rotation angle of a boom 20 of a machine 10. For example, the rotational position system 39 may receive the data indicative of a horizontal rotation angle of the boom 20 (and/or the swing casting 31) via one or more communication lines communicatively connecting the position sensor 38 and the rotational position system 39. The rotational position system 39 may receive the data in real-time (or near real-time) during operation of the machine 10, in a streaming manner, according to a schedule, and/or the like. The horizontal rotation angle may include a side-to-side or left/right rotation angle about the axis 34.

In some aspects of the disclosure, the rotational position system 39 may activate an operation mode for modifying the horizontal rotation angle to the target. For example, the rotational position system 39 may detect that the boom 20, stick 22, bucket 26, and/or swing casting 31 are in use and may activate the operation mode based on detecting the use. Aspects described herein are not limited to detecting use of the boom 20, stick 22, bucket 26, and/or swing casting 31 and the operation mode may be activated based on any machine operation. Additionally, or alternatively, the rotational position system 39 may receive input from an operator of the machine 10 to activate the operation mode. Horizontal rotation of certain elements of the machine 10 (e.g., the boom 20, stick 22, swing casting 31, etc.) with the body 12 or about the vertical axis 34 may be referred to herein as "boom swing."

At step 104, the method 100 may include determining that the horizontal rotation angle of the boom 20 deviates from a target horizontal rotation angle. For example, the rotational position system 39 may determine that the horizontal rotation angle of the boom 20 deviates from the target. The rotational position system 39 may perform the determination upon receiving the data at step 102, at a scheduled time after receiving the data at step 102, based on receiving a command (e.g., triggered by input from an operator of the machine 10 via a display or control panel), and/or the like. The target horizontal position may include a position of the boom 20 and/or swing casting 31 prior to drift in the horizontal position during use of linkage elements (e.g., extension/retraction of the boom 20 or the stick 22, use of the bucket 26, etc.). For example, the rotational position system 39 may activate control for drift during digging or dumping operations of the machine 10, but may deactivate the control for drift if boom swing commands are active and for a period of time after the boom swing command is inactive.

In some aspects, the rotational position system 39 may determine the target horizontal rotation angle for the boom 20 (or the swing casting 31) based on a command, based on detecting the target horizontal rotation angle, and/or the like. For example, the rotational position system 39 may receive a command to hold a current horizontal rotation angle from an operator of the machine 10 and the rotational position system 39 may set the current horizontal rotation angle as the target horizontal rotation angle. Additionally, or alternatively, and as another example, the rotational position system 39 may detect that the boom 20 and/or the swing casting 31 has been moved into a position and held there for a threshold amount of time. In this example, the rotational position system 39 may determine the held position to be the target horizontal rotation angle.

In some aspects, the rotational position system 39 may determine that the horizontal rotation angle of the boom 20 deviates from the target horizontal rotation angle by comparing the angles. For example, the rotational position system 39 may compare the horizontal rotation angle to the target horizontal rotation angle and may determine whether the angles match, whether the angles differ by a threshold amount (e.g., the horizontal rotation angle deviates from the target by at least a certain number of degrees), and/or the like. Based on this, the rotational position system 39 may detect the deviation.

At step 106, the method 100 may include sending one or more commands to modify the horizontal rotation angle of the boom 20 to the target horizontal rotation angle. For example, the rotational position system 39 may send one or more commands to modify the horizontal rotation angle of the boom 20 to the target horizontal rotation angle. The rotational position system 39 may send the one or more commands upon detecting the deviation, based on receiving input from an operator of the machine 10 to provide the one or more commands, at a scheduled time after detecting the deviation, while other functions are commanded, such as for the boom 20, the stick 22, or the bucket 26, and/or the like.

The rotational position system 39 may send the one or more commands to the boom actuator 40. For example, the one or more commands may cause movement of the boom actuator 40 in a certain direction and by a certain amount so that that the boom 20 and/or the swing casting 31 are moved to the target horizontal rotation angle.

The rotational position system 39 may perform one or more other actions in association with sending the one or more commands. For example, the rotational position system 39 may output information to a display that indicates the horizontal rotation angle, the target horizontal rotation angle, or the deviation between the horizontal rotation angle and the target horizontal rotation angle. Additionally, or alternatively, the rotational position system 39 may trigger an alarm based on detecting the deviation. Additionally, or alternatively, the rotational position system 39 may store information that indicates a deviation of a certain severity is to be corrected in the future, which may reduce or eliminate a need for the rotational position system 39 to receive a command to correct the deviation.

In some aspects, the rotational position system 39 may perform the steps 102 through 106 continuously during operation of the boom 20, the stick 22, the bucket 26, and/or the swing casting 31. For example, after sending the one or more commands at 106, the rotational position system 39 may continue to monitor the horizontal rotation angle of the boom 20 and/or the swing casting 31 by returning to step 102 and re-performing steps 102 through 106 for new data. In this way, the rotational position system 39 may continuously loop through the steps of the method 100 during operation of the boom 20 and/or the swing casting 31 or during a certain time period.

Although the method 100 illustrated in FIG. 3 is described as including steps 102 through 106, the method 100 may not include all of these steps or may include additional or different steps. For example, the method 100 may just include the operations at steps 104 and 106.

As noted above, FIG. 4 illustrates a flowchart depicting an exemplary method 200 for modifying a rotational position of a boom 20 to a default position, according to aspects of the disclosure. At step 202, the method 200 may include receiving one or more commands to set a default horizontal rotation angle for a boom 20 of a machine 10. For example, the rotational position system 39 may receive the one or more commands from a control panel of the machine 10 (e.g., based on operator input to the control panel), from a remote device (e.g., from a remote operator or a remote server device), and/or the like. In some aspects, the default horizontal rotation angle may be pre-stored in memory of the rotational position system 39 or another device, and the rotational position system 39 may access the stored information.

The default horizontal rotation angle may include a position of the boom 20 and/or swing casting 31 to which the boom 20 and/or swing casting 31 are to be moved after use of the boom 20. For example, the default horizontal rotation angle may include a position centered in a permitted range of motion for the boom 20 or swing casting 31, a position that corresponds to a digging, drilling, etc. location, a position that corresponds to a dumping location, and/or the like. In this way, the boom 20 may be moved about during operations of the machine 10 and the default horizontal rotation angle may include a position to which the boom 20 and/or swing casting 31 can be returned at the conclusion of use of the boom 20 or at certain stages of use of the boom 20. Additionally, or alternatively, the default horizontal position may include a starting position of the boom 20 (or the swing casting 31) prior to use, an in-use position set by an operator of the machine 10, and/or the like.

In some aspects, the rotational position system 39 may activate an operation mode for modifying the horizontal rotation angle to the default. For example, the rotational position system 39 may detect that the boom 20 and/or swing casting 31 are in use and may activate the operation mode based on detecting the use. Aspects described herein are not limited to activating the operation mode based on detecting use of the boom 20 and/or swing casting 31, and the operation mode may be activated based on any operation of the machine 10. Additionally, or alternatively, the rotational position system 39 may receive input from an operator of the machine 10 to activate the operation mode.

At step 204, the method 200 may include receiving, from a position sensor, data indicative of a horizontal rotation angle of the boom 20. For example, the rotational position system 39 may receive the data in a manner similar to that described above in connection with step 102 of the method 100 illustrated in FIG. 3. At the step 206, the method 200 may include receiving one or more commands to modify a rotation angle of the boom 20 from the horizontal rotation angle to the default horizontal rotation angle. For example, the rotational position system 39 may receive the one or more commands from a control panel or joystick(s) of the machine 10 (e.g., based on operator input to the control panel), from a remote device (e.g., from a remote operator or a remote server device), and/or the like. In some aspects, rather than receiving the one or more commands, the rotational position system 39 may determine to modify the rotation angle. For example, the rotational position system 39 may detect that the bucket 26 has been loaded or unloaded and may determine to return the boom 20 and/or swing casting 31 to the default horizontal rotation angle (e.g., corresponding to a dumping or loading location). Additionally, or alternatively, and as another example, the rotational position system 39 may detect that the boom 20, the swing casting 31, or an implement 26 connected to the boom 20 is no longer in use and may determine to return the boom 20 and/or the swing casting 31 to a position, such as a straight ahead position, until subsequent use.

As another example the system can stop an operator requested boom horizontal rotation command such that the swing casting 31 is positioned to the default horizontal rotation angle. Continuing with the previous example, the rotational position system 39 may receive user input to modify the horizontal position of the boom 20 and/or the swing casting 31 from a current horizontal position to another horizontal position (e.g., where the other horizontal position is either the default horizontal position or a position different from the default horizontal position). If the other horizontal position input by the user is the default horizontal position, then, in connection with the step 208 below, the rotation position system 39 may send a command to modify the current horizontal position to the default horizontal position. Alternatively, if the other horizontal position input by the user is different from the default horizontal position, then, in connection with the step 208 below, the rotational position system 39 may block the command from the user and may instead send a command to modify the current horizontal position to the default horizontal position.

At step 208, the method 200 may include sending one or more commands to modify the rotation angle. For example, the rotational position system 39 may send the one or more commands to one or more boom actuators 40 to modify the rotation angle of the boom 20 and/or the swing casting 31. The rotational position system 39 may send the one or more commands to modify the rotation angle after receiving the one or more commands at step 206, at a later time after receiving the one or more commands at step 206, and/or the like.

The one or more commands may include signaling that causes the boom actuators 40 to move the boom 20 and/or the swing casting 31 in a horizontal direction (e.g., in a left or right direction). In some aspects, the one or more commands may indicate a position (e.g., in terms of degrees of rotation from a reference point), a direction of movement, an amount of movement in the direction (e.g., in terms of degrees), and/or the like. In some aspects, the movement that the one or more commands indicate or cause may be the same for the boom 20 and/or the swing casting 31, may be different for the boom 20 and the swing casting 31, and/or may be partially the same and partially different for the boom 20 and the swing casting 31. For example, the one or more commands may cause the boom 20 and the swing casting 31 to move in a same direction and by a same amount, may cause the boom 20 and the swing casting 31 to move in the same direction by different amounts, or may cause the boom 20 and the swing casting 31 to move in different directions. In some aspects, the one or more commands may include a command to wait until the boom 20 (or the swing casting 31) is not in use before modifying the horizontal rotation angle. Additionally, or alternatively, the rotational position system 39 may determine that the boom 20 (or the swing casting 31) is not in use and may send the one or more commands after determining that the boom 20 (or the swing casting 31) is not in use. Additionally, or alternatively, the one or more commands may include a command to wait to modify the horizontal rotation angle until input from an operator of the machine 10 to modify the position is received.

The rotational position system 39 may perform one or more actions in connection with sending the one or more commands at the step 208. For example, the rotational position system 39 may output information to a display that indicates the position or the boom 20 and/or the swing casting 31 relative to the default position. Additionally, or alternatively, and as another example, the rotational position system 39 may output trigger an alarm when moving the boom 20 and/or the swing casting 31 to the default position.

Although the method 200 illustrated in FIG. 4 is described as including steps 202 through 208, the method 200 may include less than all of these steps or may include additional or different steps. For example, the method 200 may just include the operations at 206 and 208.

In this way, certain aspects of the disclosure may help to maintain an accurate position of the boom 20 and/or swing casting 31 during operations of the machine 10. For example, the position of the boom 20 and/or the swing casting 31 may drift over time as a result of loads in the bucket 26, and certain aspects may make adjustments to the position of the boom 20 and/or the swing casting 31 to keep the boom 20 and/or the swing casting 31 in a target position. In addition, certain aspects may return the boom 20 and/or the swing casting 31 to a default position without the operator having to control the boom 20 and/or the swing casting 31. For example, in earth moving operations, the operator may set a precise dumping location as the default location and certain aspects may automatically move the boom 20 and/or the swing casting 31 to the dump location based on a command to make the move. This may help to improve an accuracy of operations of the machine 10, such as in scenarios where it is important for excavating to take place in an area with limited movement (e.g., where excavating has to avoid underground utilities). As another example, to achieve maximum linkage reach and maintain trench alignment, the operator may desire the boom swing to be oriented straight forward unless more advanced linkage positioning is desired. By using the combination of methods 100 and 200, the system can quickly return to this position and maintain the position until the operator desires a change. The use of these control systems in conjunction with grade control systems may improve the overall system accuracy relative to grade control systems that are not capable of compensating for boom swing position.

It will be apparent to those skilled in the art that various modifications and variations can be made to the disclosed system without departing from the scope of the disclosure. Other aspects of the system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A system associated with a machine, comprising:
a boom actuator;
a position sensor; and
a rotational position system, wherein the rotational position system is configured to:
receive, from the position sensor, data indicative of a horizontal rotation angle of a boom of the machine relative to a body of the machine;
determine whether the horizontal rotation angle of the boom of the machine deviates from a target horizontal rotation angle relative to the body of the machine; and
upon detecting that the horizontal rotation angle of the boom of the machine deviates from the target horizontal rotation angle, send, to the boom actuator, one or more commands to modify the horizontal rotation angle of the boom to the target horizontal rotation angle,
wherein the target horizontal rotation angle includes a position of the boom and a position of a swing casting prior to drift in the horizontal rotation angle during operation, and
wherein the swing casting is fixedly connected to an end of the boom such that the boom is rotatable horizontally about an axis.

2. The system of claim 1, wherein the rotational position system is further configured, when sending the one or more commands, to:
send the one or more commands to modify the horizontal rotation angle to the target horizontal rotation angle based on determining that the horizontal rotation angle deviates from the target horizontal rotation angle, wherein the one or more commands include a command to wait until boom swing is not in use before modifying the horizontal rotation angle.

3. The system of claim 1, wherein the rotational position system is further configured to:
receive user input to set a default horizontal rotation angle relative to the body of the machine prior to receiving the data.

4. The system of claim 3, wherein the rotational position system is further configured to:
receive user input to modify the horizontal rotation angle from a current horizontal rotation angle to another horizontal rotation angle.

5. The system of claim 4, wherein the rotational position system is further configured, when sending the one or more commands, to:
send the one or more commands to modify the horizontal rotation angle to the default horizontal rotation angle.

6. The system of claim 1, wherein the machine comprises an excavator.

7. The system of claim 1, wherein the rotational position system is configured to send, to the boom actuator, the one or more commands to modify the horizontal rotation angle only when boom swing is not in use and for a period of time after the boom swing is inactive.

8. A method, comprising:
receiving, from a position sensor associated with a machine, data indicative of a horizontal rotation angle of a boom of the machine relative to a body of the machine,
wherein the position sensor is fixedly mounted to a boom link of the machine and is fixedly connected through one or more links to the boom; and
sending, to a boom actuator, one or more commands to modify the horizontal rotation angle of the boom relative to the body of the machine to a target horizontal rotation angle relative to the body of the machine,
wherein the target horizontal rotation angle comprises a position of the boom and a position of a swing casting relative to the body of the machine prior to drift in the horizontal rotation angle during operation of linkage elements of the machine, and
wherein the one or more commands to modify the horizontal rotation angle of the boom relative to the body of the machine are only sent when boom swing is not in use and are not sent when the boom swing is in use.

9. The method of claim 8, further comprising:
determining that the horizontal rotation angle deviates from the target horizontal rotation angle based on the data indicative of the horizontal rotation angle; and
sending the one or more commands to modify the horizontal rotation angle to the target horizontal rotation angle based on determining that the horizontal rotation angle deviates from the target horizontal rotation angle, wherein the one or more commands include a command to wait until the boom swing is not in use before modifying the horizontal rotation angle.

10. The method of claim 8, further comprising:
determining to activate an operation mode for modifying the horizontal rotation angle to the target horizontal rotation angle based on detecting an operation of the machine.

11. The method of claim 8, further comprising:
determining that the boom swing is not in use; and
wherein the sending of the one or more commands further comprises:
sending the one or more commands to modify the horizontal rotation angle to the target horizontal rotation angle after determining that the boom swing is not in use, and
wherein the method further includes deactivating the one or more commands to modify the horizontal rotation angle of the boom if the boom swing is in use.

12. The method of claim 8, further comprising:
receiving one or more commands to set a default horizontal rotation angle prior to receiving the data.

13. The method of claim 8, further comprising:
receiving user input to modify the horizontal rotation angle from a current horizontal rotation angle to a default horizontal rotation angle prior to sending the one or more commands.

14. The method of claim 13, wherein the default horizontal rotation angle comprises one or more of:

a starting horizontal rotation angle of the boom relative to the body of the machine prior to use of the boom, or an in-use position set by an operator of the machine.

15. A rotational position system associated with a machine, the rotational position system being configured to:

receive, from a position sensor associated with the machine, data indicative of a horizontal rotation angle of a boom of the machine relative to a body of the machine, wherein the position sensor is fixedly mounted to a boom link of the machine and is fixedly connected through one or more links to the boom; and send, to a boom actuator, one or more commands to modify the horizontal rotation angle of the boom to a target horizontal rotation angle relative to the body of the machine, wherein the target horizontal rotation angle comprises a position of the boom and a position of a swing casting prior to drift in the horizontal rotation angle during use of linkage elements of the machine, wherein the swing casting is fixedly connected to an end of the boom such that the boom is rotatable horizontally about an axis relative to the body of the machine, wherein the rotational position system is configured to only send the one or more commands to modify the horizontal rotation angle of the boom relative to the body of the machine during digging or dumping operations, when boom swing is not in use, and for a period of time after the boom swing is inactive, such that the rotational position system does not send the one or more commands to modify the horizontal rotation angle of the boom relative to the body the machine when the boom swing is active.

16. The rotational position system of claim 15, wherein the rotational position system is further configured to:

determine that the horizontal rotation angle deviates from the target horizontal rotation angle based on the data indicative of the horizontal rotation angle of the boom relative to the body of the machine; and send the one or more commands to modify the horizontal rotation angle to the target horizontal rotation angle based on determining that the horizontal rotation angle deviates from the target horizontal rotation angle, wherein the swing casting is a 2-bar linkage or a 4-bar linkage.

17. The rotational position system of claim 15, wherein the rotational position system is further configured to:

determine to activate an operation mode for modifying the horizontal rotation angle to the target horizontal rotation angle based on detecting an operation of the machine.

18. The rotational position system of claim 15, wherein the rotational position system is further configured to:

determine that the boom swing is not in use; and wherein the sending of the one or more commands further comprises:

sending the one or more commands to modify the horizontal rotation angle to the target horizontal rotation angle after determining that the boom swing is not in use.

19. The rotational position system of claim 15, wherein the rotational position system is further configured to:

receive user input to set a default horizontal rotation angle prior to receiving the data, and wherein the default horizontal rotation angle comprises a position of the boom to which the boom is to return after use.

20. The rotational position system of claim 19, wherein the rotational position system is further configured to:

receive user input to modify the horizontal rotation angle from a current horizontal rotation angle to the default horizontal rotation angle prior to sending the one or more commands to modify the horizontal rotation angle to the default horizontal rotation angle.

* * * * *